United States Patent [19]

Mason

[11] Patent Number: 4,945,654

[45] Date of Patent: Aug. 7, 1990

[54] APPLICATION OF SUPERHEATED STEAM

[76] Inventor: Robert J. H. Mason, 17-8720 Maple Grove Crescent, Burnaby, British Columbia, Canada, V5A 4G5

[21] Appl. No.: 342,981

[22] Filed: Apr. 20, 1989

[51] Int. Cl.[5] ..... F26B 3/00

[52] U.S. Cl. ..... 34/23; 34/119; 34/124

[58] Field of Search ..... 34/119, 124, 23, 22, 34/46, 54, 12; 162/207, 206, 290; 100/38, 93 RP

[56] References Cited

U.S. PATENT DOCUMENTS 4,624,744 11/1986 Vreeland .
4,749,445 6/1988 Vreeland .
4,765,067 8/1988 Taylor ..... 34/54

FOREIGN PATENT DOCUMENTS 1011585 6/1977 Canada .
488951 2/1918 France ..... 34/119

OTHER PUBLICATIONS

Dunfield et al./Gravure Printability . . . , Journal of Pulp and Paper Science: V12, #2, 3/1986.
Keller, The Effect of Calendering Steam Treatment . . . , Canadian Pulp and Paper Assoc., 1/1988.
The Effects of Z-Direction Moisture . . . , Gratton et al., Journal of Pulp and Paper Science, V14, #4, Jul. 1988, pp. J82-J90.
Black, The Effects of Moisture and Temperature on Paper . . . Calender Seminar, 1988-03-25.
Crotogino et al., Hard Nip and Soft Nip Calendering . . . , MR109 Pulp and Paper Institute of Canada, 3/1987.
Hilden et al., Calender Steam Showers . . . , Tappi Journal, vol. 70, Jul./1970.
David et al., Effects of Superheated Steam . . . , Canadian Pulp and Paper Assoc. Jan./1988, pp. B233-B237.
Vyse et al., Practical Aspects of Calender Steam Showers, Tappi Journal, Oct./1988, pp. 87-90.
Newsprint Calendering: An Experimental Comparison of Temperature and Loading Effects, Pulp and Paper Canada, vol. 75, No. 11, Nov. 1974.
The Effect of Moisture and Moisture Gradients on the Calendering of Paper, Lyne, British Board Industries Fed., London, 7/1978, vol. 2, pp. 641-669.
Temperature-Gradient Calendering, Crotogino, Tappi Journal/Oct. 1982, pp. 97-101.

*Primary Examiner*—Henry A. Bennet
*Assistant Examiner*—John Sollecito

[57] ABSTRACT

Superheated steam is applied directly to the surface of a web of paper or the like to significantly increase at least the surface temperature of the web impinged by the superheated steam thereby to significantly heat the paper. The web, after steam treatment, is immediately passed into a nip. The steam applicator is maintained at a temperature above 100° C. to insure that condensation problems are substantially avoided and most if not all the steam condensed in the web. An applicator for superheated steam comprises a heated chamber having a steam inlet and apertures through which steam is directed from the chamber toward a travelling web, the chamber is heated to a temperature to ensure that the steam leaving the chamber through the apertures has the desired degree of super heat, i.e. moisture to heat content to raise the temperature of the web without undue amount of condensation forming on the equipment.

16 Claims, 3 Drawing Sheets

APPLICATION OF SUPERHEATED STEAM

FIELD OF THE INVENTION

Present invention relates to a steam applicator for applying superheated steam to a web such as a web of paper and to a method of surface treating a web of paper by applying steam from an applicator maintained at a temperature of more than 100° C. to increase the temperature of the web significantly while avoiding significant condensation problems.

BACKGROUND OF THE INVENTION

Calendering paper by supercalendering, hard nip calendering or soft nip calendering has been used in the paper industry for many years and the operations of such calenders have been studied and numerous reports written.

In Pulp and Paper Canada, Volume 75, No. 11, November 1974 in a paper by Kerekes and Pye entitled "Newsprint Calendering: An Experimental Comparison of Temperature and Loading Effects", an experimental program is reported wherein nip loading, number of nips and temperature of the rolls were discussed particularly in reaction to hard roll calendering. The conclusions reached indicate that heating the rolls can reduce the number of nips or pressure necessary to obtain a selected density and that higher temperature rolls improve the gloss.

Canadian Pat. No. 1,011,585 issued June 7, 1977 to Anderson is one of the earlier discussions of what appears to be a moisture and temperature gradient calendering system wherein moisture is applied to the sheet and then the sheet is drawn over a hot platen.

The concept of moisture gradient calendering was discussed in British Board Industries Fed., London, 1978, Vol. 2, pages 641–669 in an article entitled "The Effect of Moisture and Moisture Gradients on the Calendering of Paper" by Lyne. In this paper the concept of plastic flow and softening of lignin by moisture and temperature is discussed and the effect of these parameters on the surface of a web under conditions of conventional roll temperature, high roll temperatures and a combination of high roll temperatures and moisture application immediately before the calender nip is examined.

In an article entitled "Temperature-gradient Calendering" by Crotogino published in the Tappi Journal-/October 1982, pages 97–101, the effect temperature gradient calendering of paper is described. The surface of the paper web is heated but the heat does not have time to penetrate to the inside of the paper web which remains relatively cool as the web passes through the calender nip. This results in development of improved surface properties without significant compaction of the middle of the sheet thereby to reduce strength loss by the calendering operation.

Dunfield et al, in an article entitled "Gravure Printability of Steam-Treated Machine Calendered Newsprint" published in the Journal of Pulp and Paper Science: Vol. 12, No. 2 March 1986, describes, among other things, the application of steam in a steam shower before the nip of a calender and indicates that improved results can be obtained by moisture gradient calendering even without added heat.

U.S. Pat. Nos. 4,624,744 issued Nov. 25, 1986 and 4,749,445 issued June 7, 1988 to Vreeland describe the effects of temperature gradient calendering using a soft backing roll.

In a paper given at the 1988 Annual Meeting of the Canadian Pulp and Paper Association, Technical Section, Jan. 28–29, 1988, entitled "The Effect of Calender Steam Treatment and Roll Temperature on Newsprint Properties" by Keller, the effect of temperature gradient calendering with steam treatment before the high temperature nip was further examined and it was found that the steam treatment before the high temperature nip produced the highest MD Tensile and CD Tear strength values for a given roughness. Also the use of a high roll temperature increases gloss for a given density. It was further noted that the application of steam slightly reduced the beneficial effect of the high calender temperature on gloss and reported that the addition of steam even when calendering to higher densities did not develop the same gloss as was developed using high temperature rolls only.

In a paper entitled "The Effects of Z-Direction Moisture and Temperature Gradients in the Calendering of Newsprint" by Gratton et al, published in Journal of Pulp and Paper Science, Volume 14, No. 4, July 1988, pages J82–J90, the effect of both temperature and moisture gradient calendering on the surface of paper were examined and it was concluded that the application of moisture to the surface of the paper when using a high temperature calender roll was not significantly different compared with calendering with a roll at the same temperature without added moisture.

A paper entitled "Effects of Moisture and Temperature on Paper Properties with Implications for Hot Calendering", Kalender Seminar Konigsbronn 1988-03-25 by Black, further discusses moisture content and temperature in the calendering nip and concludes that one of the major advantages of hot calendering is rapid solidification on the exit side of the hot nip thereby reducing springback indicating that a high moisture content is only an advantage when sufficient water is evaporated in the nip to achieve a rapid solidification. This paper also suggests that it might be advantageous from a brightness point of view to limit the temperature of the surface to less than about 150° C.

Miscellaneous reports MR 109 by the Pulp and Paper Research Institute of Canada, in a paper entitled "Hard Nip and Soft Nip Calendering of Uncoated Groundwood Papers", March 1987 by Crotogino et al, a review of the established, new emerging calendering techniques is provided and it is stated that steam showers may be used to help reduce bulk and improve the surface properties of a paper.

In the Black paper above discussed, it has been suggested that too high a roll temperature in the calender may be detrimental to the gloss characteristics of the treated paper.

It will be apparent from the above that the concepts of temperature and moisture gradient calendering have been well investigated and the basic conclusion reached by the experts is that temperature gradient or high temperature calendering is beneficial, that moisture gradient calendering is also beneficial but when both moisture and temperature gradient calendering are used, gloss is substantially the same or possibly reduced compared with that obtained if only temperature gradient calendering were being carried out.

In a paper entitled "Calender Steam Showers—An Effective New Way of Hot Calendering" by Hilden et al, Tappi Journal, Vol. 70, July 1987, describes a new design of steam shower for applying steam in the calender stack. This shower is more fully described, it is believed, in the October, 1988 Tappi Journal entitled "Practical Aspects of Calender Steam Showers" by Vyse et al, pages 87-90.

In a more detailed article entitled Calender Steam Showers—A New Effective Means of Hot Calendering by Hilden and Sawley published in Pulp and Paper Canada, Volume 88, No.12 (1987) T452-T455 the steam application of steam to paper in the calenders is described. Similar equipment and processes are described in the Finishing and Converting Conference 1986, TAPPI Proceedings pages 95-100 by Hilden and Sawley and the May 14-16, 1987 Spring Conference of the Canadian Pulp and Paper Association Preprints pages 1-6 inclusive. All of the three publications are recited since there are minor differences in what is disclosed in each publication. For example, in the Pulp and Paper reference, high energy transfer is referred to and a steam iron effect which includes contact between the sheet and the steam applicator is described whereas in the other papers no contact is referred to. In the latest publication, of which applicant is aware and which it is believed relates to the same steam shower device, entitled Controlling Paper Smoothness using Calender Steam Showers by Vyse and Sawley presented in 1989 at the Annual Meeting of the Canadian Pulp and Paper Association, (see pages A205-A209 in the preprints for the meeting), further information is provided on the steam pressures and temperatures used in the system and steam showers are stated to be close to, i.e. close clearance from the sheet (page A206, Column 1, line 6).

In the later publication the steam pressure supplied to the steam shower is defined as high as 8 psig at temperatures of 115-125° C.

In the earlier papers, the highest temperature that could be reached on the paper was 100° C. and this was determined by the temperature of the sheet approaching the steam shower. No absolute value for the sheet temperature is described in the latest paper however the plotted temperature increase appears to reach about 20° in FIG. 3 but is defined as 23° minimum in Table 1.

In all cases the increase in smoothness obtainable when practicing the method of these papers appears to be up to about 10 points (Sheffield smoothness) improvement which is barely significant.

In all of the above devices wherein steam is applied to the web while the steam supplied to the applicator or shower may contain a minor degree of superheat, by the time it is cooled by the applicator itself and reaches the paper, the steam likely is about saturated, i.e. a temperature of probably no more than 100° C.

One of the problems in utilizing current technology is condensation problem of the steam not contained within the intestees of the webs. Also, the use of saturated steam limits the maximum temperature to which the surface of the sheet may be raised to about 100° C.

The use of superheated steam in paper making is not new. The effect of the application of super heated steam during drying is discussed in a paper entitled "Effect of Superheated Steam Drying on Paper Properties" by David et al, was presented to the Annual Meeting of the Canadian Pulp and Paper Association, Technical Section, Jan. 28-29, 1988, see pages B233-B237 of the preprints. In this paper, superheated steam is applied to a handsheet to dry the handsheet and it was found that some of the physical and optical properties of the resultant dry paper were significantly better than those that would be obtained with normal air drying, however no practical way of drying using superheated steam is suggested.

A BRIEF DESCRIPTION OF THE PRESENT INVENTION

It is an object of the present invention to provide an applicator for applying a steam in superheated steam form to the surface of a moving web, particularly an applicator for impinging superheated steam directly onto the surface of a travelling web.

It is a further object of the present invention to provide a method of applying superheated steam directly to the surface of a moving web while reducing significantly the amount of condensate formed in the immediate vicinity of the applicator.

It is a further object of the present invention to reduce the amount of condensation formed from steam from the applicator other than that used to heat the web and facilitate surface finishing of paper web in a calender.

Broadly the present invention relates to a method and apparatus for applying steam to a surface of a web comprising delivering steam in superheated condition from an applicator located immediately adjacent to a surface of said web by said steam, maintaining the temperature of said applicator at above 100° C. and impinging said superheated steam directly against said surface of the web thereby to heat at least said surface of said web without significant condensation of said steam other than on said web.

Preferably the system of the present invention will be used in conjunction with a calender using either hard rolls or a combination of soft and hard rolls and the superheated steam will preferably be applied to the surface of the web to first be contacted by the hard roll.

Broadly the present invention also relates to a method comprising treating the surface of a travelling web by applying steam in superheated steam form and by directing steam from an applicator maintained at a temperature of at least 110° C. to apply superheated steam directly on to a surface of said web as it travels past an applicator to heat at least said surface of said web to modify the characteristics of at least the surface of the web and passing said web through a treatment zone while the characteristics of said surface are substantially in their modified form to facilitate treatment of said web in said treatment zone. The treatment zone will normally take the form of a nip to reform the web to reduce the caliper of said web while modifying the surface characteristics of the web.

The present invention also relates to an applicator for applying a fluid in a gaseous state to a travelling surface of a web, said applicator comprising a chamber, means for introducing steam into said chamber, heater means for heating said chamber to transfer heat to said steam in said chamber, outlet means from said chamber, means for moving a web past said outlet means, said outlet means being directed toward a surface of said web to be contacted by said steam, said web moving across said outlet means in close proximity thereto so that said steam issuing from said outlet impinges directly on said surface without significant cooling of said superheated steam between said outlet means and said surface.

Preferably said close proximity is sufficiently close that said web contacts a surface of said applicator, said surface of said applicator being heated to and maintained at a temperature above 100° C. and transferring heat to said web.

Preferably said treatment zone will comprise a calender nip.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

The present invention will be described primarily with respect to calenders but it will be apparent that it may be applied in many other applications particularly for treating or making paper.

Figure 1:
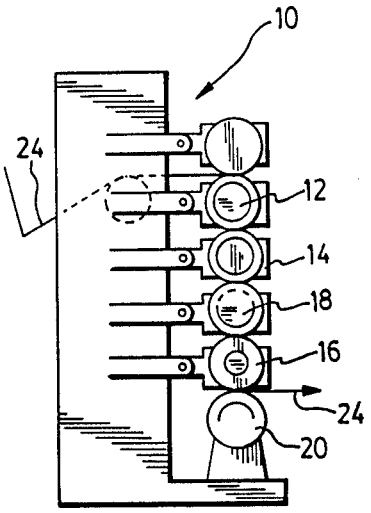
FIG. 1 is a side elevation of a conventional calender stack on a paper machine

FIG. 1 shows a typical, calender stack 10 composed of a plurality of rolls arranged in the stack. Some of the rolls, such as the rolls 12, 14 and 16 may be heated and an intermediate roll such as the roll 18 may be a variable crown roll to ensure more uniform application of pressure. Similarly the bottom roll 20 may be a swimming roll to help maintain the uniformity of nip pressures along the axial length of the nips. Not all of the rolls need to be driven. Generally only one roll such as the roll 16 is driven.

Figure 2:
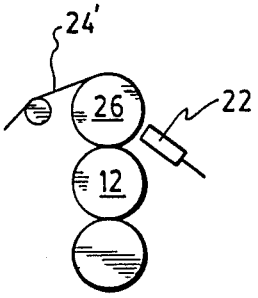
FIG. 2 illustrates one location for application of superheated steam in accordance with the present invention.

Superheated steam from applicator 22 which is maintained at a temperature above 100° C. is directed against the surface of the web of paper 24. The applicators 22 may be positioned in any suitable location in the calendar for example as indicated in FIG. 2 to apply superheated steam to the adjacent exposed face of the paper web 24 to preheat this surface immediately before it enters the nip and contacts the roll 12. In many cases the roll 12 may be a heated roll. The effect of the application of superheated steam to the surface of the web 24 will be described below.

Figure 3:
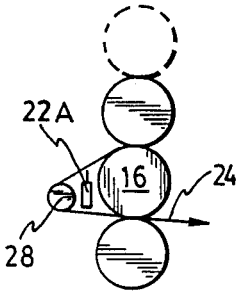
FIG. 3 illustrates another location for application of superheated steam on a conventional calender.

FIG. 3 shows an arrangement wherein the paper web is stripped from one of the rolls of the calender, in this case roll 16, is passed over a turning roll 28 and is heated by superheated steam directed thereagainst from the applicator 22A positioned within the loop of the paper 24. As described above, the applicator is maintained at a temperature above 100° C., preferably above 110° C., and superheated steam is applied to the surface of the web 24 immediately before contact with the roll 16. The higher the applicator temperature the more heat that may be transferred to the web, thus it is preferred to operate with applicator temperature higher than 120° C. but not so high as to damage the web.

Figure 4:
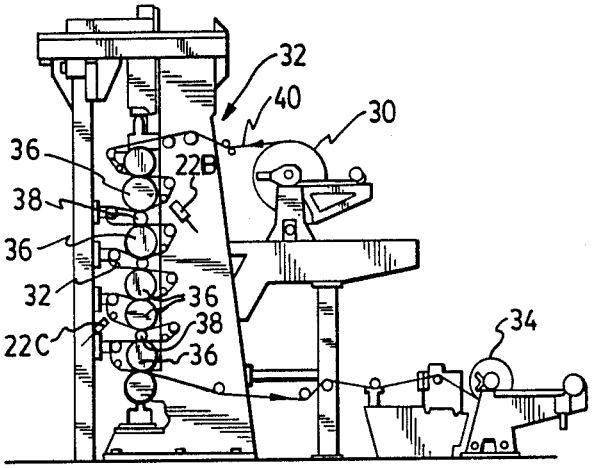
FIG. 4 shows a conventional supercalender but with superheated steam applicators of the present invention located at selected locations in the stack.

Generally in most applications on the paper machine superheated steam may be applied in the same location as saturated steam is normally applied to heat and add moisture to the web but with the applicator maintained at above 100° C. and superheated steam being applied the applicator can be made small so it can apply steam close to a nip and apply the amount of energy required FIG. 4 is a view similar to FIG. 1 but illustrates a typical supercalender having an unwind stand 30, calender stack 32 and a rewind stand 34. The calender stack is normally formed by alternating soft rolls 36 and intervening hard rolls 38 that generally will be heated. Superheated steam is applied by the applicators 22 in the illustrated arrangement first to one surface of the web 40 and then to the other surface of the web 40 as indicated by the applicators 22B and 22C respectively. It will be noted that in each case the superheated steam is applied to the surface of the web 40 that is about to contact a hard roll 38. As in the previous arrangements the applicator 22 is maintained at a temperature of above 100° C.

Figure 5:
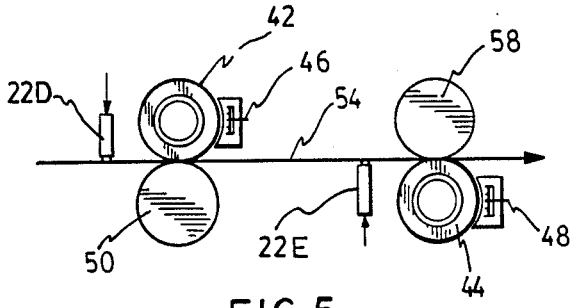
FIG. 5 is a schematic illustration of a hard nip calender incorporating the superheated steam applicators of the present invention.

In FIG. 5 a temperature gradient on-line calender utilizing a pair of hard rolls forming each nip is illustrated. As shown the rolls 42 and 44 are heated by magnetic induction heaters 46 and 48 (other heating means such as internal oil heating may be used). The rolls 42 and 44 form nips with solid or hard rolls 50 and 58 respectively. The paper web travels from the first nip formed between the rolls 42 and 50 to the second nip formed between the rolls 44 and 58. Immediately prior to the first nip when practicing the present invention a superheated steam applicator 22D is provided to direct superheated steam onto the surface of the web 54 on the side of the web that will contact the heated roll 42. A second applicator 22E is positioned to direct superheated steam onto the bottom or opposite surface of the web 54 to heat this surface immediately before the web 54 traverses the second nip. The side of the web 54 heated by the applicator 22E is the side that contacts the heated roll 44.

While rolls 42 and 44 that contact the side of the web against which superheated steam is applied have been shown as heated such heating may not be necessary depending on the condition of the surface of the web when it contacts these rolls. The application of superheated steam permits obtaining a web surface temperature significantly higher than those attained when saturated steam was applied and the effect of heating the rolls is reduced. When the temperature is raised sufficiently high by the application of superheated steam (and heated applicator), it may be desirable to cool these rolls to freeze the surface of the web before it leaves the nip.

Figure 6:
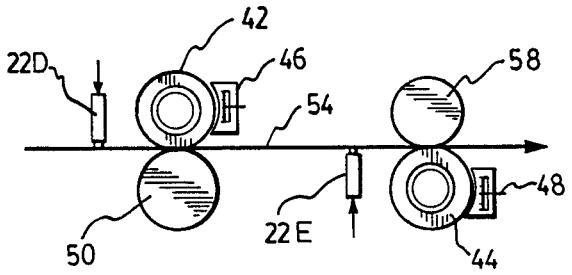
FIG. 6 is similar to FIG. 5 but showing a soft nip calender incorporating the present invention.

The arrangement illustrated in FIG. 6 is essentially the same as FIG. 5 and like reference numerals have been used to illustrate like parts. The difference between the embodiment of FIG. 6 and that in FIG. 5 is in FIG. 6 rolls 50 and 58 are intended to be soft rolls or alternatively cooled rolls depending on the application to which the process is to be applied. Again it will noted that the applicators 22D and 22E apply superheated steam to the surface of the web to be contacted by the hard or forming roll as this is the surface to be modified (smoothed). The rolls 42 and 44 as above described need not be heated.

The particular structure of the applicators i.e. 22, 22A 22B, 22C, 22D, 22E, 22F, will be described in detail hereinbelow with reference to FIG. 8 and 9, however generally each is provided with at least one row of apertures extending substantially the full width of the paper sheet to apply superheated steam over the full width of the paper sheet. If desired, these apertures may be replaced by a narrow slot. Means will be provided to maintain the applicator at a temperature above 100° C. Normally as will be described below this will comprise a heater, but if the incoming steam is sufficiently superheated the incoming steam may be used to maintain the applicator above 100° C.

Figure 7:
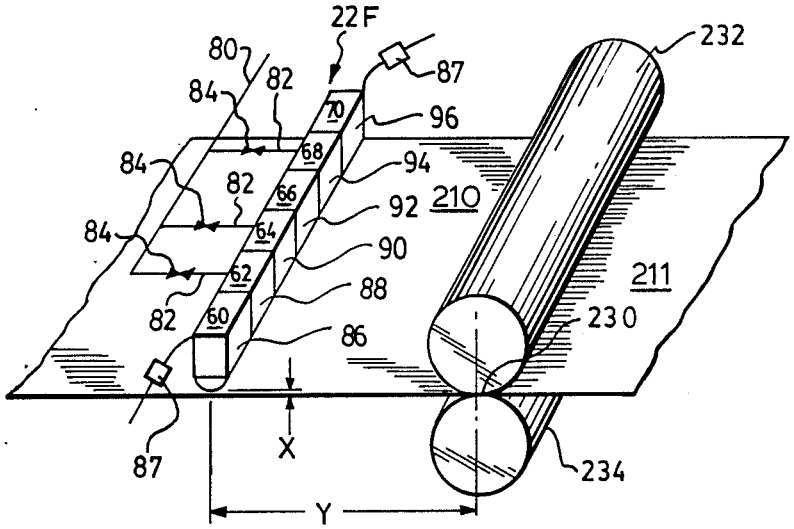
FIG. 7 is a side elevation view of an applicator constructed in accordance with the present invention and divided into segments extending transverse of the web, i.e. broken into a plurality of compartments each extending only a portion of the width of the web.

The applicators 22 obviously will extend substantially the full width of the web such as the webs 24, 40 and 54 and each will be maintained at a temperature above 100° C. and will have the capability of applying superheated steam to the web. If cross machine profiling is desired, i.e. different rates or temperatures of steam application in different areas spread transversely of the direction of travel of the web are desired, the applicator will be divided into a plurality of isolated side by side compartments, such as the applicator illustrated in FIG. 7 and indicated at 22F. In this arrangement there are six different compartments indicated at 60, 62, 64, 66, 68, and 70 divided into groups which in this case are composed of pairs of adjacent compartments such as compartments 60 and 62; 64 and 66; and compartments 68 and 70. Each of these groups of adjacent compartments are fed with steam from the main header 80 via branch ducting 82, there being one duct 82 for each pair of compartments. The flow through each of the branch lines or ducts 82 is controlled by a valve 84. These valves 84 may each be individually controllable if desired. If desired each compartment may be isolated from the others and separate ducting 82 and values 84 provided for each compartment.

Each of the compartments 60, 62, 64, 66, 68, and 70 preferably is provided with its own heater as illustrated at 86, 88, 90, 92, 94, and 96 respectively and each of the compartments may be provided with its own independent temperature control 87 (only two shown but one may be provided for each heater 86–96). Temperature may also be regulated by providing two steam headers at different temperatures and controllably blending steam from each heater into each compartment to control the temperature of the incoming steam as desired to a temperature between the temperatures of the steam in the two heaters. In some cases where incremental control across the web is not needed, a single compartment with a single heater may be used to extend the full width to be treated of the web.

Figure 8:
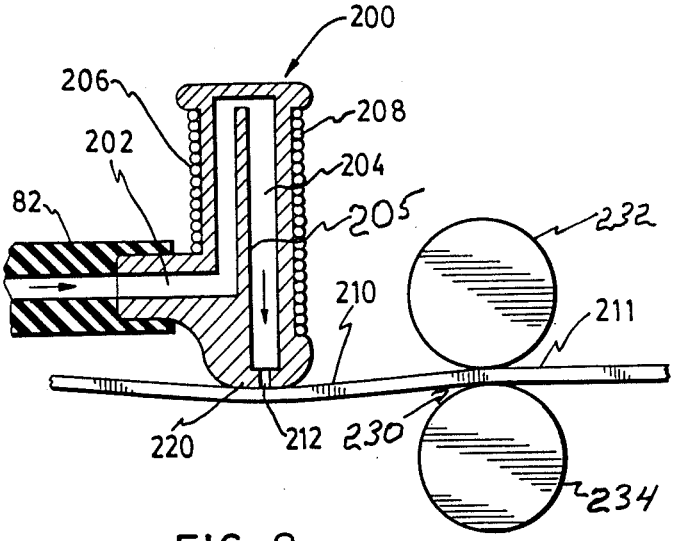
FIG. 8 is a schematic section through an applicator constructed in accordance with the present invention.

A cross section through a particular compartment is illustrated in FIG. 8 Steam is directed into the applicator 200 (which may be any one of the applicators 22 to 22F inclusive) via the inlet 202 and enters a compartment 204. A central partition 205 causes the steam to flow along one side and then along the other side of the compartment when passing from the inlet 202 to the outlet orifices 212. Heating coils 206 are provided on at least one side of the compartment 204, in the illustrated arrangement a heating coil or the like 206 and/or 208 (i.e. heaters 86–96 inclusive) is provided one on each side of the compartment 204. Any suitable type of heater, provided it will develop the required heat and temperature for transfer to the steam, may be used as heater 206 and/or 208 and thus as heaters 86–96. The steam itself may be used to heat the applicator if the incoming steam is sufficiently superheated that even after losing heat to the applicator the steam contacting the web still has the required degree of superheat to heat the web surface to the desired degree and maintain the applicator at a temperature of over 100° C. Applicant prefers to use an electrical heater and to transfer heat to the steam and to the web contacting the applicator.

Within the chamber 204 the temperature of the steam entering through inlet 202 is adjusted to insure the steam is superheated and has the desired degree of superheat when leaving the applicator to contact the web as will be described hereinbelow. Preferably the steam will be heated to a temperature higher than the incoming steam thereby to superheat or further superheat the steam immediately prior to application to the surface of the web 210.

The paper temperature approaching the applicator will normally be less than about 90° C. and in those applications where the web actually contacts the applicator heat is transferred between the applicator and the web. Under these conditions it is important that either the degree of superheat of the steam entering the applicator be sufficient to compensate for the heat transfer between the web and applicator to ensure that the steam leaving the applicator has the required degree of superheat or sufficient heat be added via the heating coils or the like to the applicator again to ensure that the temperature of the superheated steam applied to the web is sufficiently high.

Even when there is no contact between the web and the applicator it is very important to insure that the temperature of the applicator is above 100° C. or significant condensation problems may be encountered because of the compact design. The temperature of the applicator 22 should be maintained at least sufficiently high that the steam issuing therefrom remains superheated until it contacts the web.

The superheated steam in the chamber 204 issues through apertures such as the circular aperture 212 and directly impinges on the adjacent surface 211 of the web 210.

Figure 9:
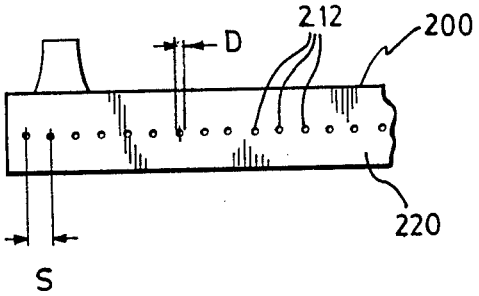
FIG. 9 is a view of the outlets from the applicator in one embodiment of the present invention.

Generally, as illustrated in FIG. 9, the applicator 200 (i.e. 22–22F) will be provided with a plurality of apertures 212 arranged in a row extending substantially the full width of the applicator which normally will extend the full width of the web to be treated. It has been found that when utilizing the present invention and applying superheated steam, the size of the apertures that can be employed may be smaller than the normal aperture size used in the application of saturated steam, however the precise size as indicated by the diameter D and spacing as indicated by the dimension S are not critical and in fact all of the orifices 112 could be interconnected to form a slot. However, care must be taken to ensure that the total area of the outlet does not apply too much steam or too little back pressure on the steam or the velocity of the steam exiting the applicator may be too low for some applications. In a particular example as will be discussed below, apertures of 1/32 of an inch in diameter at 1/10th of an inch spacing, i.e. D=1/32 of an inch and S=1/10 of an inch were found to be satisfactory. Clearly these dimensions may be changed.

The use of a heated applicator permits the feed or incoming steam to be at a low pressure and not be significantly superheated if at all and the steam to be superheated immediately before application to the web. This is simpler than supplying steam with a degree of superheat to compensate for cooling of the steam by the applicator and still be sufficiently superheated when the steam contacts the web, i.e. preferably with a steam temperature at least 110° C. In some cases depending on the application to which the superheated steam is to be applied, applicator temperatures maintained as high as practical generally higher than about 125° C.

The distance X between the applicator and the web (see FIG. 7) generally should not exceed about 1 inch and even at a spacing of 1 inch the superheated steam expands and loses much of its heat before it contacts the paper and will not be as effective in reducing the amount of condensate formed around the equipment. Thus it is preferred to maintain the distance X small generally less than ⅛ inch and in most cases, particularly when applying superheated steam to a paper web for calendering, equal 0, i.e. the applicator surface 220 (see FIGS. 8 and 9) will contact the paper web and will deflect the web, for example a deflection of about ¼ inch when positioned in the middle of a 2 foot span has been found satisfactory. It will be apparent that the temperature of the surface 220 of applicator is relatively high and heat will be transferred from the applicator surface to the web to contribute to the heating of the web. The heat transfer from the applicator to the web will depend on the speed of the web and degree of contact between the web surface and the heated applicator and the temperature of the web and applicator.

The distance Y between the applicator orifices or outlets 112 and the nip 230 between the rolls such as those illustrated at 232 and 234 (which are representative of the calender nips above described) simply determines time (dependent on web speed) for the steam to transfer heat into the web and then for the surface to cool. Heat penetration is desirable to ensure the surface of the sheet is at elevated temperature to the required depth. It is preferred to position applicators 22 relatively close to the nip and Y generally will be no greater than 2 feet and preferably will be less than 6 inches, and most preferably less than about two inches. It is not clear exactly what the maximum spacing or distance y that may be tolerated is since the surface of the web has been observed to cool rapidly, yet the web seems to retain the characteristics necessary to facilitate calendering.

It will be apparent that the speed of the web has a bearing on the maximum length Y that can be tolerated and still have the web in desired condition when entering the nip since the faster the sheet is travelling the less time to travel distance Y and the less time for cooling. Heat transfer to the web is extremely rapid and cooling is more time dependent.

The roll 232 may, if desired, be heated and may be equivalent to the rolls 12, 38, 42 or 44 described above while the roll 234 which combines with the roll 232 to form the nip 230 may be equivalent to any one of the rolls 14, 36, 50, or 58, i.e. may be any suitable hard or soft roll. It will be apparent that the surface 214 heated by the jets issuing from the outlets 212 passes directly into contact with the roll 232 in the nip 230.

In a calendering operation for calendering paper the amount and temperature of the superheated steam applied coupled with the heat transfer between the applicator and web will be sufficient to heat at least the surface of the web at least at the point of contact by the steam sufficiently high to modify the characteristics of at least the surface of the web to facilitate the calendering operation and produce the desired surface finish to the web.

It is possible to darken the surface of a paper web by overheating and this should be avoided thus generally the surface of the web should not exceed a temperature where darkening of the particular web being treated occurs.

The effectiveness of heating the applicator was determined by measuring the steam temperatures ½ inch away from the outlet apertures of the applicator with and without the heater activated. When the heater was activated the applicator block temperature was maintained at about 250° C.

EXAMPLE 1

TABLE 1

| Applicator Back Pressure (psi) | Steam Temperature at X = ½ inch: Applicator Block Heated to 250° C. °C. | Steam Temperature at X = ½ inch: Applicator Block Not heated °C. |
|---|---|---|
| 1 | 204 | 70 |
| 2 | 171 | 72 |
| 3 | 160 | 78 |
| 4 | 144 | 80 |
| 5 | 132 | 80 |

As shown in Table 1 with the applicator heated the steam temperature measured at ½ inch from the applicator surface is considerably higher than when the applicator is not heated. Also it will be noted that as the flow of steam through the device increased (pressure increased), the temperature of the steam decreased, i.e. the heating capability of this version of the applicator was not sufficient to maintain the high temperature at the high flow rate used. When there was no heating of the applicator the temperature of the steam slightly increased as the flow increased but the temperature remained low in comparison with that obtained when the block was heated. Operation without heating the applicator produces a condensation problem. If the incoming steam to the applicator were sufficiently superheated this steam could be used to heat the applicator to above 100° C. so that the steam contacting the web would be sufficiently superheated to pre-soften the surface of the web.

In this example, the heating chamber of the heated applicator was about 5 inches by ½ inch wide and the applicator was 30 inches long and provided with 6 steam inlets over the 30 inches, i.e. a header with 6 branch pipes was used so that each section or compartment of the applicator was 5 inches in the cross machine direction.

The outlet from the heated applicator was composed of a straight row of orifices about 1/32 of an inch in diameter spaced 1/10 inches apart.

EXAMPLE 2

The temperature of the superheated steam likely to contact the web was measured using an applicator with two rows of orifices while varying the steam flow rates. The block temperature was maintained in the range of about 225°–250° C. (block temperature is to a degree dependent on the temperature and flow rate of the incoming steam).

The temperature of the steam was measured at different spacings from the applicator, i.e. distance X was varied from 3/64th of an inch to one inch.

It is apparent from Table 2 that at the lower flow rates the temperature of the steam is relatively high at short distances of X, i.e. up to about over 200° C. whereas at the large spacing, i.e. X=1 inch, the temperature of the steam was about 120° at 0.02 psi pressure and reduced to 77° at the higher flow rates of 0.16 psi. It is apparent that the shorter the spacing of the temperature probe from the applicator the higher the temperature and that up to spacings of ⅝th of an inch the steam temperature, regardless of the steam flow under the conditions examined, did not reduce below 100° C. or become non-superheated (this occurred at ¾ inch spacing and a back pressure between 0.04 and 0.09 psi and at 1 inch spacing somewhere between 0.02 and 0.03 psi back pressure).

It will be apparent that under most conditions examined the steam temperature applied to the web will exceed 115° C. and that the flow combined with the heat transfer from the applicator itself will ensure that the surface of the web is significantly heated.

TABLE 2

| Internal Chamber Pressure PSI | Inches Spacing from Applicator Surface X: 3/64" Steam Temp. °C. | 3/64" Block Temp °C. | ⅛" Steam Temp. °C. | ⅛" Block Temp. °C. | ¼" Steam Temp. °C. | ¼" Block Temp. °C. | ½" Steam Temp. °C. | ½" Block Temp. °C. | ¾" Steam Temp. °C. | ¾" Block Temp. °C. | 1" Steam Temp. °C. | 1" Block Temp. °C. |
|---|---|---|---|---|---|---|---|---|---|---|---|---|
| 0 | 200 | 243 | 146 | 252 | 88 | 243 | 65 | 248 | 59 | 255 | 52 | 244 |
| .01 | 216 | 233 | 197 | 238 | 170 | 238 | 143 | 239 | 139 | 242 | 137 | 247 |
| .02 | 220 | 234 | 211 | 237 | 201 | 236 | 156 | 234 | 132 | 243 | 120 | 246 |
| .03 | 216 | 232 | 206 | 234 | 204 | 233 | 143 | 228 | 122 | 239 | 90 | 236 |
| .04 | 215 | 230 | 204 | 232 | 203 | 232 | 130 | 229 | 108 | 235 | 86 | 233 |
| .09 | 215 | 230 | 204 | 232 | 204 | 231 | 126 | 229 | .99 | 231 | 81 | 231 |
| .12 | 215 | 230 | 205 | 230 | 204 | 230 | 125 | 230 | 95 | 229 | 80 | 231 |
| .13 | 214 | 229 | 204 | 230 | 204 | 230 | 123 | 232 | 91 | 227 | 79 | 230 |
| .15 | 213 | 227 | 204 | 228 | 204 | 230 | 125 | 234 | 94 | 228 | 77 | 231 |
| .16 | 213 | 228 | 202 | 228 | 204 | 229 | 119 | 229 | 91 | 228 | 76 | 231 |
| .16 | 213 | 228 | 202 | 227 | 203 | 230 | 114 | 227 | 91 | 229 | 79 | 230 |
| .16 | 212 | 227 | 202 | 228 | 203 | 229 | 113 | 225 | 90 | 229 | 77 | 231 |

At the end of the experiment the heater for the block was turned off and the steam was applied at full flow rate, i.e. 0.16 psi back pressure and the rate of cooling of the applicator was measured. At the commencement of the measuring the temperature was about 230° C. After 3 minutes it had dropped 10 degrees. After 5 minutes it had dropped about 30 degrees. After 8 minutes over 50 degrees to a temperature of about 180° and after 10 minutes was down to about 165° for a total temperature drop over 10 minutes of almost 70° C. thereby clearly indicating that the heater was contributing significantly to the temperature of the steam.

It will be apparent that with a different heater or more effective heater, the actual heat transferred to the steam in the applicator may be changed.

EXAMPLE 3

A series of tests were run using a steam back pressure of 0.12 psi and the steam temperature was measured 1/16 inch from the applicator block as the applicator block was heated. Table 3 shows the results obtained.

TABLE 3

| Applicator Block Temp., °C. | X = 1/16 inch Steam Temp., °C. |
|---|---|
| 100 | 100.1 |

TABLE 3-continued

| Applicator Block Temp., °C. | X = 1/16 inch Steam Temp., °C. |
|---|---|
| 105 | 100.6 |
| 110 | 102.5 |
| 115 | 111.4 |
| 120 | 113.0 |
| 125 | 119.0 |
| 130 | 125.8 |
| 135 | 129.0 |
| 140 | 132.8 |
| 145 | 137.6 |
| 150 | 141.7 |
| 155 | 146.2 |
| 160 | 149.7 |
| 165 | 153.6 |
| 170 | 157.4 |
| 175 | 162.0 |
| 180 | 165.7 |
| 185 | 169.6 |
| 190 | 177.4 |
| 195 | 180.6 |
| 200 | 185.7 |
| 205 | 193.4 |
| 210 | 195.3 |
| 215 | 199.0 |
| 220 | 202.0 |
| 225 | 210.0 |
| 230 | 214.0 |
| 235 | 218.0 |

Stabilized at approx. 236° C. (block)

For the heater used the highest block temperature reached was about 236° C.

It will be apparent that with the block at at least 100° C. the steam issuing therefrom is still slightly superheated at the 1/16 inch spacing. At an applicator block temperature of 110° C. the steam had about 2.5° superheat at the 1/16 inch spacing. Obviously if the steam temperature could be measured closer to the block it would be even higher.

EXAMPLE 4

As above indicated in the discussion of the prior art, temperature has a very pronounced effect on gloss and moisture content has more effect on roughness, by adjusting applicator block temperature and back pressure, i.e. flow, one could obtain any reasonable desired ratio of temperature to moisture content in the steam contacting the paper so that for any given paper the device can be fine tuned to optimize the properties of the paper.

In a comparison the present invention with saturated steam application, paper treated in a conventional supercalendering operation using a calender arrangement having 11 nips and 5 steam showers (3 showers applied to one side and 2 to the other) was compared with essentially the same paper treated in a supercalender having 10 nips and 2 applicators of the present invention operating with a spacing X=0 and a block temperature of 160°. Table 4 compares the results obtained at the same calender loading. The nip roll temperatures used were about 80° to 90° C.

TABLE 4

| | Change in | | | |
|---|---|---|---|---|
| | Density grm/cm$^3$ | Gardiner Gloss 75% % | Parker Roughness (Units) | Porosity ml/min |
| 5 Conventional Steam Showers 11 Nips | +.02 | +3% | −.2 | −15 |
| 2 Applicators of Present Invention 10 nips | +.13 | +15% | −.9 | −42 |

The above tests were on a supercalender, however similar relative improvements are obtainable using soft calendering or hard nip calendering.

While the above description is related primarily to calendering, it will be understood that the applicator may be used in a variety of different applications, for example, in the press section of the paper machines it is possible to use the present invention to apply superheated steam, i.e. more BTU's per pound of moisture added to the paper and practice impulse drying. It will also be apparent that because the temperature of the steam issuing from the applicator is controlled by the heat added in the application by providing suitable heat transfer means the desired degree of heat (temperature) to moisture content can be adjusted within limits immediately before application to a web by simply changing the degree of superheating. If more moisture is required more steam is applied and thereby the ratio of temperature to moisture may be reduced or alternatively more temperature may be applied to less steam to increase this ratio as desired for the particular application. This also permits cross machine moisture profiling.

Similarly in the above description the single applicator has been used, obviously a plurality of applicators side by side might be used to increase the amount of superheated steam directed at the web or one applicator with sufficient size heaters and retention time but having more than one row of apertures may be used.

The size of the applicator may be made very small in comparison to conventional steam showers or applicators, thus it may be applied in locations when a conventional steam applicator does not fit. Also because it can apply superheated steam, i.e. is maintained at a temperature above 100° C. preferably above 105° C. or 110° C. it can be used to apply heat and moisture to webs travelling thereby in other equipment than paper making equipment for example in corrugators for making corrugated paper board. Also instead of smoothing and improving printability the nip rolls might apply a pattern to the web for example to obtain a sheen or matte finish or other pattern.

Having described the invention modification will evident to those skilled in the art without departing from the spirit of the invention as defined in the appended claims.

I claim:

1. A method of applying steam to a surface of a web comprising delivering steam in superheated condition from an applicator located immediately adjacent to a surface of said web to be impinged by said steam, moving said web relative to said applicator, transferring heat to said steam in said applicator immediately before said steam leaves said applicator to ensure said steam is in superheated condition when it issues from said applicator by maintaining said applicator at a temperature above 100° C., directing said superheated steam issuing from said applicator toward said web and impinging said steam of said surface as said surface is moved passed said applicator without significant condensation of said steam other than on said web.

2. A method as defined in claim 1 further comprising immediately after impinging said steam on said surface, passing said web while at elevated temperature produced by the application of said steam into a nip formed by a pair of rolls one of which contacts said surface of said web.

3. A method as defined in claim 2 wherein said applicator is maintained at a temperature of above 110° C.

4. A method as defined in claim 2 wherein said web is positioned so that the distance between said surface of said web and a surface of said applicator from which said superheated steam is discharged is less than ½ inch.

5. A method as defined in claim 3 wherein said web is positioned so that the distance between said surface of said web and a surface of said applicator from which is superheated steam is discharged is less than ½ inch.

6. A method as defined in claim 4 wherein said distance is zero and wherein said surface of said web and said surface of said applicator from which said superheated steam is discharged are in direct contact and heat is transferred from said applicator to said web.

7. A method as defined in claim 5 wherein said distance is zero and wherein said surface of said web and said surface of said applicator from which said superheated steam is discharged are in direct contact and heat is transferred from said applicator to said web.

8. A method as defined in claim 1 wherein said applicator is maintained at a temperature of at least 110° C.

9. A method as defined in claim 3 wherein applicator is maintained at a temperature above 125° C.

10. A method as defined in claim 6 wherein applicator is maintained at a temperature above 125° C.

11. A method as defined in claim 7 wherein said applicator is maintained at a temperature above 125° C.

12. A method as defined in claim 2 wherein applicator is maintained at a temperature above 125° C.

13. An applicator for applying superheated steam against a travelling surface of a web, said applicator comprising a chamber means for introducing said steam into said chamber, heater means for heating said chamber and increasing the temperature of said steam, outlet means from said chamber, means for moving said web past said outlet means, said outlet means opening directly toward a surface and web to be contacted by said steam, means for relatively positioning said web and said outlet means in close proximity to ensure that said steam at elevated temperature issuing from said outlet impinges directly on said surface of said web without significant cooling of said steam between said chamber and said web.

14. An applicator as defined in claim 13 wherein said means for relatively positioning positions said web in direct contact with a surface of said applicator through which said outlet means opens as said web traverses said applicator.

15. An applicator as defined in claim 14 further comprising a calender nip into which said web passes after application of said steam to said surface of said web.

16. An applicator as defined in claim 13 wherein said heater means comprises electric heating elements in said applicator.

* * * * *